US005652031A

United States Patent [19]

Commanda

[11] Patent Number: 5,652,031

[45] Date of Patent: Jul. 29, 1997

[54] VISUAL DISPLAY OF BEADS

[76] Inventor: Ephrem E. Commanda, Box 345, Sturgeon Falls, Ontario, Canada, P0H 2G0

[21] Appl. No.: 273,112

[22] Filed: Jul. 11, 1994

[51] Int. Cl.[6] ..... B44F 3/00

[52] U.S. Cl. ..... 428/13; 428/46; 428/67

[58] Field of Search ..... 428/13, 38, 46, 428/67, 39, 95; 156/63, 10; 427/203, 23; 434/83

[56] References Cited

U.S. PATENT DOCUMENTS

| | | | |
|---|---|---|---|
| 520,385 | 5/1894 | Allen | 40/154 |
| 2,148,632 | 2/1939 | Lovejoy | 434/83 |
| 2,937,931 | 5/1960 | Nugent | 428/39 X |
| 3,806,397 | 4/1974 | Kukoff | 428/87 X |
| 3,947,992 | 4/1976 | Lemelson | 428/38 X |
| 4,083,740 | 4/1978 | Hamanaka | 428/11 X |
| 4,128,447 | 12/1978 | Rork | 428/38 X |
| 4,318,946 | 3/1982 | Pavone | 428/38 X |
| 4,824,729 | 4/1989 | Livi | 156/63 X |
| 4,940,153 | 7/1990 | Pilgrim, Jr. | 156/63 X |
| 5,154,959 | 10/1992 | Rossi | 428/38 X |
| 5,199,200 | 4/1993 | Howell | 428/14 X |

*Primary Examiner*—Henry F. Epstein
*Attorney, Agent, or Firm*—Leonard Bloom

[57] ABSTRACT

A visual display of colored beads and methods for the preparation thereof. The display includes a pattern, a transparent substrate secured over the pattern, beads disposed on the substrate and a sealant that is disposed over the beads and the substrate for sealing the display so that the beads may not be accidentally dislodged or removed therefrom and a permanent display is formed. The method includes disposing sealant over the beads so that either a smooth finish is formed or so that the texture of the beads is exposed to touch and sight.

9 Claims, 11 Drawing Sheets

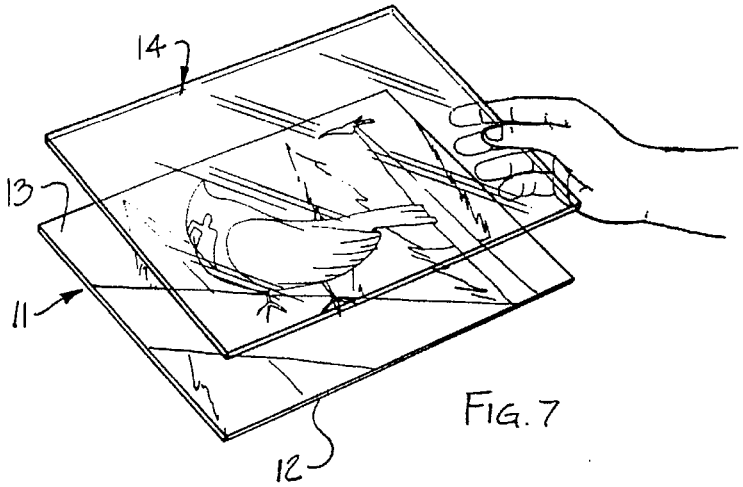
FIG. 7
FIG. 8
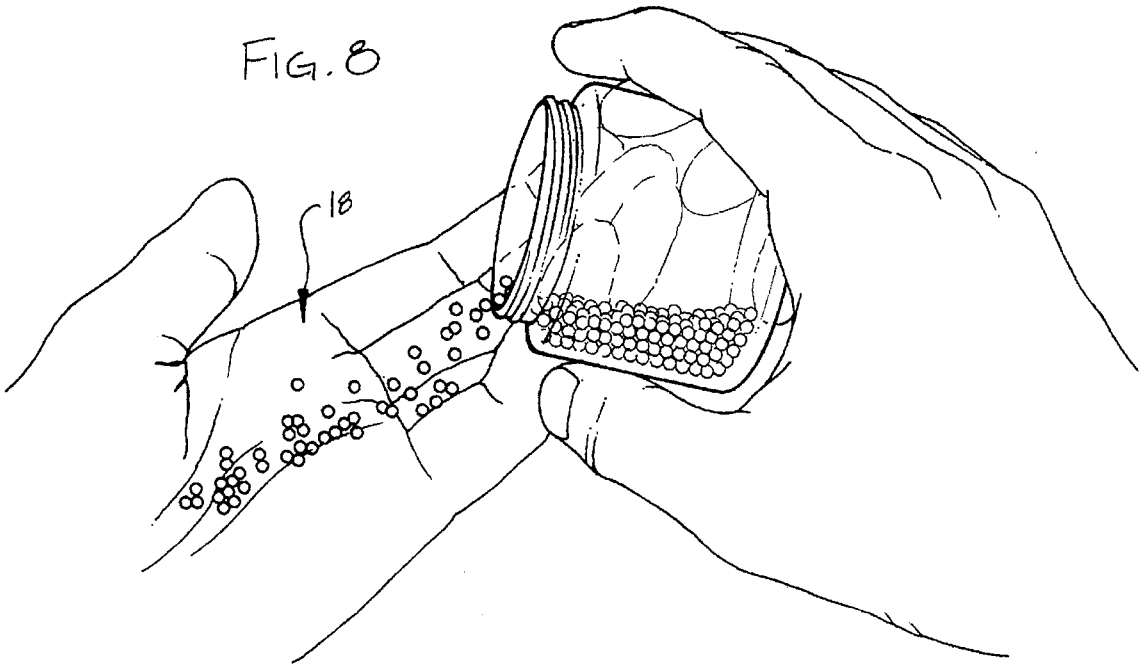

VISUAL DISPLAY OF BEADS

FIELD OF THE INVENTION

The present invention relates to visual displays and methods for the preparation thereof and, more particularly, to such visual displays of beads and methods for the preparation of the same.

BACKGROUND OF THE INVENTION

The concept of placing colored beans on an adhesive to produce a visual display is known. An example of such a display, and the method for making the same was disclosed in U.S. Pat. No. 2,937,931 issued to Nugent.

While such visual displays are pleasing to the eye, they nonetheless suffer several drawbacks that limit their preparation. First, such a display includes organic matter, such as navy beans, that are readily subject to decomposition. Second, in order to avoid decomposition, the use of such beans also requires that the artisan waterproof or lacquer each of the beans before use, a step which can be complicated, expensive or injurious to the artisan's health. Also by lacquering or waterproofing the beans prior to use, one can interfere with the ability of the adhesive to securely hold the bean in place. Finally, the use of such beans requires that each of the beans be dyed prior to placement, with the same attendant problems as those which are encountered in the waterproofing or lacquering of the beans.

Additionally, all of the displays of this nature, of which I am aware, have the drawback that each of the beans is relatively easily able to be accidentally dislodged from the remainder of the visual display.

Accordingly, it can be seen that there remains a need for a visual display made from beads wherein the beads are securely retained in place on the same, so that the beads may not be accidentally dislodged or removed therefrom, as well as methods for the preparation of such visual displays, which method is simple, inexpensive and safe for the artisan to employ.

SUMMARY OF THE INVENTION

It is a primary object of the present invention to provide a visual display of beads wherein the beads are secured to the display in such a manner that they may not be accidentally dislodged or removed therefrom.

It is a further primary object of the present invention to provide a method for the preparation of such a visual display which is simple, in expensive and safe to use.

It is a yet further primary object of the present invention to provide such a method for the preparation of a visual display made from beads in which the beads are secured to the display in such a manner that the beads cannot be accidentally dislodged or removed therefrom.

In accordance with the teachings of the present invention, a display made of beads, such as seed bead, is disclosed that is sealed in a transparent sealant. This display includes a selected pattern depicting the display and including the desired colors thereof. A transparent substrate is provided that has an upper side and a lower side. An adhesive is disposed on the upper side and the lower side of the transparent substrate. The transparent substrate is disposed on the selected pattern, so that the adhesive on the lower side of the substrate adheres the transparent substrate to the pattern. A plurality of beads of desired colors are disposed the upper side of the substrate over the selected pattern including the colors thereof. In this fashion, the adhesive on the upper side of the substrate adheres the beads to the transparent substrate over the corresponding colors of the pattern, whereby the colored beads reproduce the color pattern of the selected pattern. Finally, sealant is disposed on the upper side of the substrate and the beads adhered thereon. In this manner, the display is sealed so that the beads may not be accidentally dislodged or removed therefrom, and a permanent display is obtained.

Preferably, a first thread having a first desired length is provided. The first thread has at least a first portion of the beads of a desired color disposed thereon, whereby a first string of beads having a first desired length is defined. The first string of beads is disposed on a selected portion of the upper side of the substrate. A second thread having a second desired length is also provided. The second thread has at least a second portion of the beads of a desired color disposed thereon, whereby a second string of beads having a second desired length is defined. Finally, the second string of beads is disposed on a selected portion of the upper side of the substrate.

It is contemplated herein that the sealant is a transparent epoxy plastic, whereby the display is sealed in the transparent epoxy plastic.

In a preferred embodiment, the transparent epoxy plastic substantially covers all of the beads, such that the beads are completely embedded in the epoxy plastic and a smooth finish is formed.

In another preferred embodiment, the transparent epoxy plastic covers the beads, such that the beads are sealed therein with the irregular surface of the coated beads exposed to touch and sight.

In further accordance with the teachings of the present invention, a method for the preparation of a display made of beads sealed in a transparent sealant is disclosed. This method includes the step of providing a selected pattern depicting the display and including desired colors thereof. Another step involves providing a transparent substrate having an upper side and a lower side. Disposing an adhesive on the upper side and on the lower side of the substrate is also involved as is placing the lower side of the transparent substrate on the pattern, wherein the adhesive on the lower side of the substrate adheres the transparent substrate to the pattern. Providing a plurality of beads of desired colors is also involved. The method still further includes disposing the colored beads that correspond to the color of the pattern on the upper side of the transparent substrate, wherein the adhesive on the upper side of the substrate adheres the colored beads to the upper side of the substrate over the selected pattern including the colors thereof, such that the colored beads reproduce the color pattern of the selected pattern. The final step involves sealing the display in the transparent sealant, whereby a permanent display is obtained.

If preferred, the method may further includes steps of stringing at least a first portion of the beads of a desired color on a thread having a first desired length, whereby a string of beads having a first desired length is obtained; disposing the string of beads on a selected portion of the upper side of the transparent substrate; stringing at least a second portion of the beads of a desired color on a thread having a second desired length, whereby a second string of beads having a second desired length is obtained; and disposing the second string of beads on a selected portion of the upper side of the transparent substrate to complete the pattern.

The step of sealing the display may involve pouring a transparent sealant over the upper side of the substrate and the beads disposed thereon and adhered thereto, whereby the display is sealed in the transparent sealant. If desired, the transparent sealant may be poured over the upper side of the substrate and the beads disposed thereon and adhered thereto until a level wherein the sealant completely covers all of the beads, whereby the beads are completely embedded in the sealant and a smooth finish is formed.

Alternatively, the step of sealing the display may involve spraying a transparent sealant over the upper side of the substrate and the beads disposed thereon and adhered thereto, whereby the display is sealed in the transparent sealant with the irregular surfaces of the coated beads exposed to touch and sight.

These and other objects of the display and the method of the present invention will become readily apparent from a reading of the following description, in conjunction with the enclosed drawings.

BRIEF DESCRIPTION OF THE DRAWINGS

FIGS. 4–18 illustrate the method for the preparation of the display of the present invention.

FIG. 4 illustrates the artisan providing a selected pattern depicting the desired display.

FIG. 5 illustrates the artisan providing a transparent substrate on the pattern.

FIG. 7 illustrates the artisan placing the substrate on the pattern.

FIG. 8 illustrates the artisan providing and choosing the colored beads to be placed on the substrate over the portions of the pattern, whose colors correspond thereto.

FIG. 9 illustrates the artisan disposing the colored beads on the substrate over those portions of the pattern having a color corresponding thereto. FIGS. 10–12 illustrate an alternative method for the artisan to dispose the beads on the substrate, wherein the artisan strings portions of beads on a first string and on a second string before placing the respective strings of beads on the substrate.

FIG. 13 illustrates an artisan forming a frame about the display by placing beads about the outer edge of the display.

FIGS. 14–16 illustrate a first preferred embodiment for sealing the display wherein the sealant is poured over the beads and the portion of the substrate on which the beads are disposed to a level wherein the sealant completely covers all of the beads, completely embedding the beads in the sealant and forming a smooth finish thereon.

FIGS. 17 and 18 illustrate a second preferred embodiment for sealing the display, wherein the sealant is sprayed over the beads and the portion of the substrate on which the beads are disposed wherein the sealant completely covers the beads with the irregular surface of the coated beads exposed to touch and sight.

DESCRIPTION OF PREFERRED EMBODIMENTS

Figure 1:
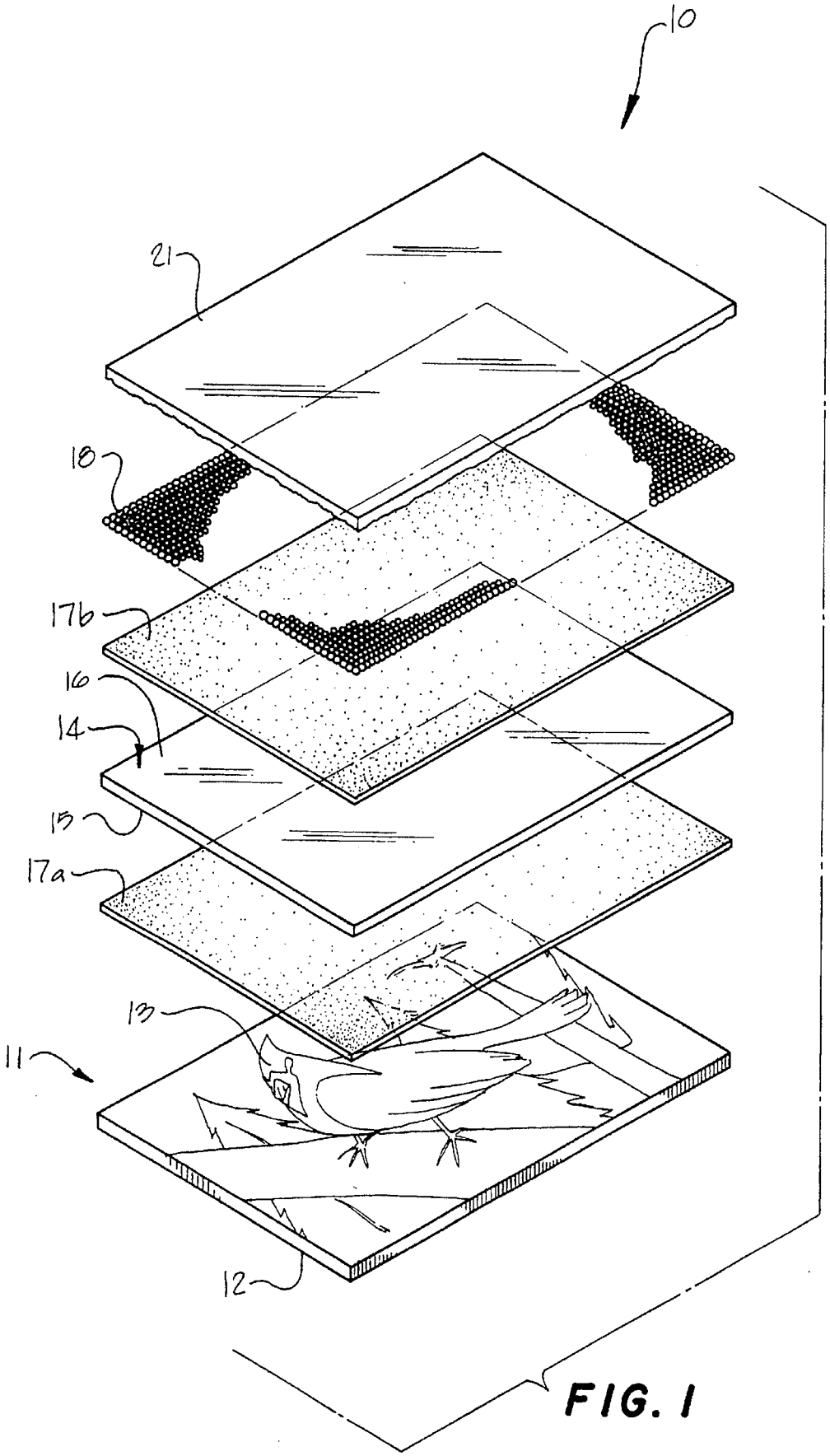
FIG. 1 is an exploded view of the display made of beads that is sealed, so as to prevent the accidental dislodgement or removal of the beads therefrom.
Figure 2:
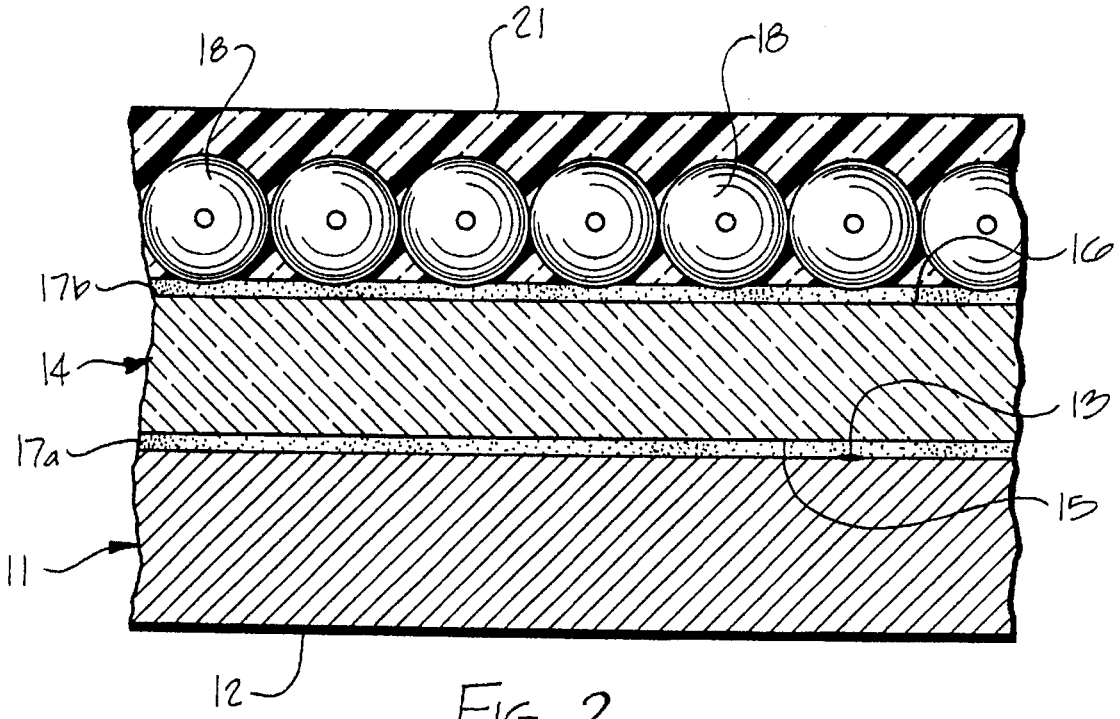
FIG. 2 is a cross-section view of the display of the present invention, illustrating a preferred embodiment of the sealant wherein the beads are completely embedded in the sealant and a smooth finish is formed.
Figure 3:
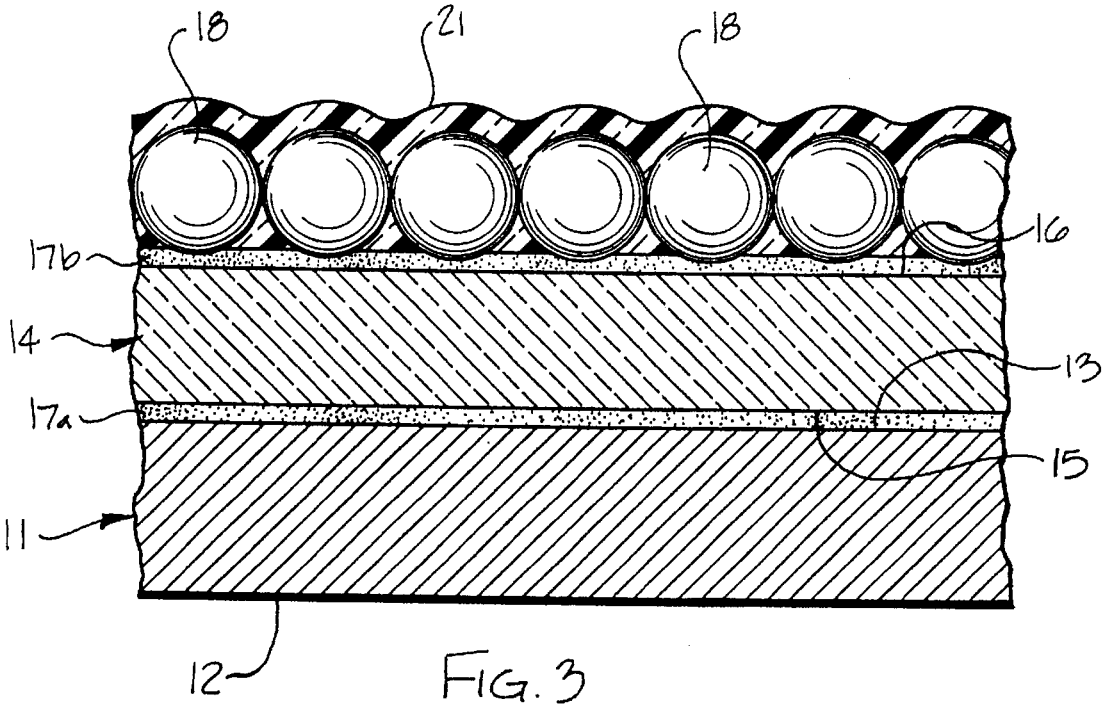
FIG. 3 is a cross-section view of the display of the present invention, illustrating another preferred embodiment of the sealant wherein the beads are sealed thereon with the irregular surface of the coated beads exposed to touch and sight.

Referring now to the drawings, and in particular to FIGS. 1–3, the display 10 of the present invention is now discussed.

The display 10 includes a pattern 11 that includes a backing 12 on which the design 13 that is desired to be depicted, including the desired colors to be displayed, is painted or drawn or positioned. It is to be understood that this backing 12 may be a rigid surface, a fabric, a sheet of paper or any other suitable material, such as a hologram or photographic paper.

The display 10 further includes a transparent substrate 14. It is contemplated herein that the substrate 14 will have the same dimensions, relative to height and length, as the pattern 11. In this fashion, when the substrate 14 is disposed on the pattern 11, the outer edges of the substrate 14 are substantially aligned and are flush with the outer edges of the pattern 11. This substrate 14 includes a lower side 15 and an upper side 16.

The substrate 14 may be a transparent photocopying material with image transferred to it by a photocopy procedure. In this manner, the pattern 11 and the substrate 14 are incorporated into a single unit effecting cost savings in reducing the number of components and in assembly time.

Disposed on both the lower and upper sides 15 and 16, respectively, is an adhesive 17*a*, 17*b*. In this fashion, when the substrate 14 is disposed on the selected pattern 11, the adhesive 17*a* on the lower side 15 of the substrate 14 adheres the substrate 14 to the pattern 11 over the design 13 thereof. Adhesive 17*a* may be as adhesive backed transparent tape. Such an arrangement permits the design 13 including the various colors thereof to be viewed through the transparent substrate 14.

Disposed on the upper side 16 of substrate 14 are a plurality of beads 18. The beads 18 may have bores therethrough to receive a stringing means or may be solid spheres without any bores or holes therein. The beads 18 have desired colors that substantially correspond to the colors on the design 13 of the pattern 11. The beads 18 are so disposed, that the adhesive 17*b* on the upper side 16 of the substrate 14 adheres the beads 18 thereto over the corresponding colors of the design 13 of the pattern 11. In this fashion, the colored beads 18 reproduce the color pattern of the design 13 of the selected pattern 11.

If desired, portions of these beads 18 may be joined to one another by a first string 19, a second string 20, etc., as shall be discussed at length below with reference to FIGS. 10–12. The various strings 19 and 20 are also disposed on selected portions of the upper side 16 of the substrate 14.

Also if desired, a plurality of beads 18 are disposed around the outer edge of the display 10. In this fashion, a frame is formed on the final display 10.

Finally, with the beads 18, adhesive 17*a*, 17*b*, substrate 14 and pattern 11 all joined to one another as discussed above, a medium or sealant 21 is disposed on the upper side 16 of the substrate 14 and the beads 18 that are adhered thereon. In this manner, the display 10 is sealed and a permanent display is formed in which the beads 18 may not be accidentally dislodged or removed therefrom. Preferably, this sealant 21 is a transparent epoxy plastic.

With particular reference now to FIG. 2, in a first preferred embodiment, the sealant 21 is disposed, so as to substantially cover all of the beads 18. In this manner, the beads 18 are completely embedded in the epoxy plastic sealant 21. In this embodiment, it is noted that the sealant is to such a level that it covers the beads 18 and a smooth finish is formed.

With particular reference now to FIG. 3, in a second preferred embodiment, the sealant 21 is disposed, so as to cover the beads 18. However, in distinction with the embodiment seen in FIG. 2, in this embodiment, the beads 18 are sealed within the sealant 21 with the irregular surface of the coated beads 18 exposed to touch and sight.

Having thus disclosed the display 10 of the present invention, referring now in particular to FIGS. 4–18, the method for the preparation of the display 10 of the present invention is now discussed.

Figure 4:
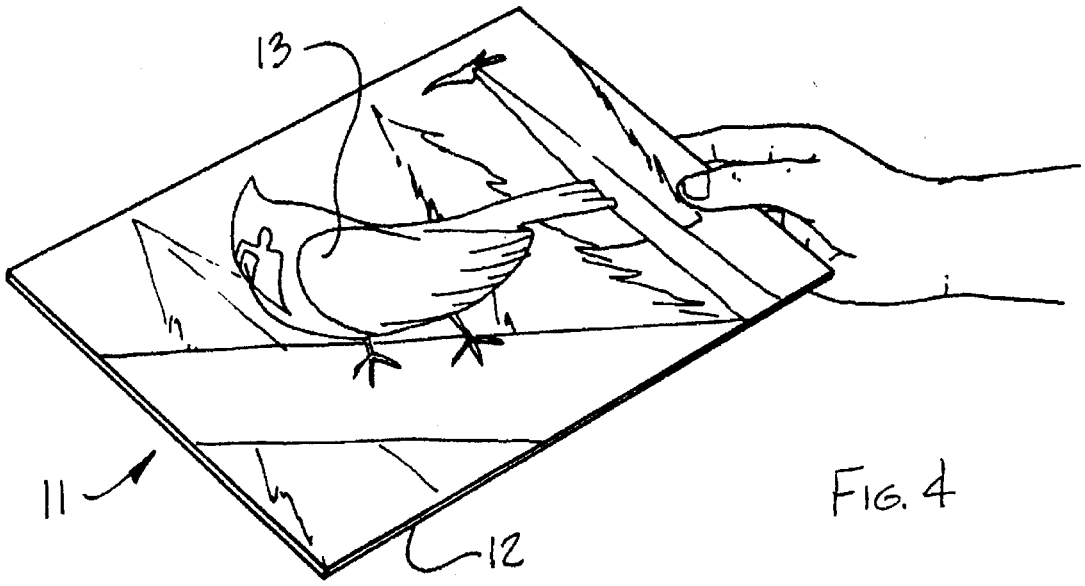

With reference first to FIG. 4, the method of the present invention is seen to require the artisan to provide the selected pattern 11 depicting the display and including the desired colors thereof. This may be done by any suitable manner, such as by the artisan himself creating the pattern, or by the artisan selecting a pattern made by another or by a photograph.

Figure 5:
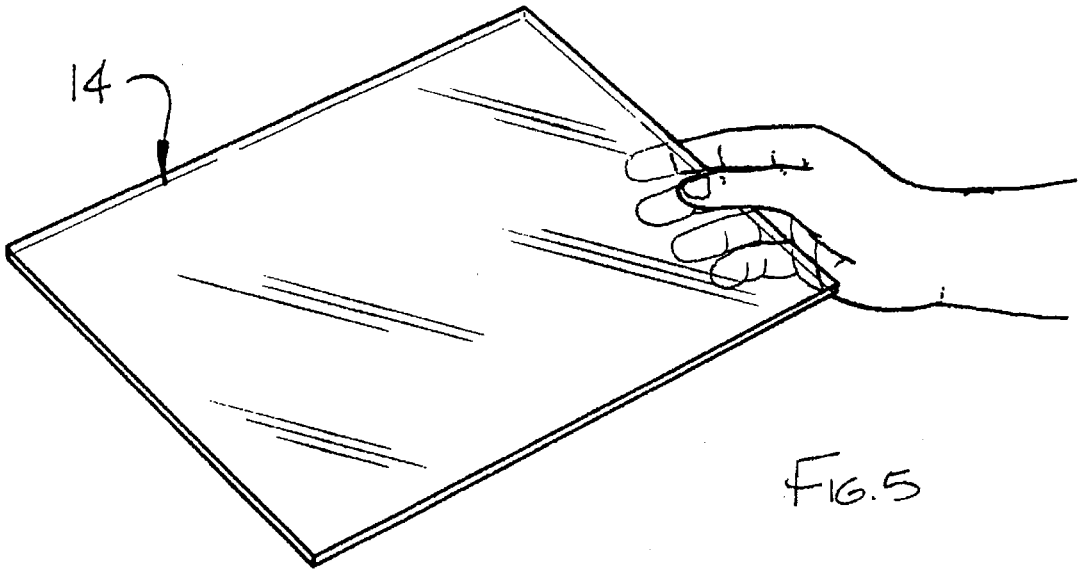

Referring now to FIG. 5, the artisan provides a substrate 14 that has an upper side 16 and a lower side 15, as was discussed above relative to FIGS. 1–3.

Figure 6A:
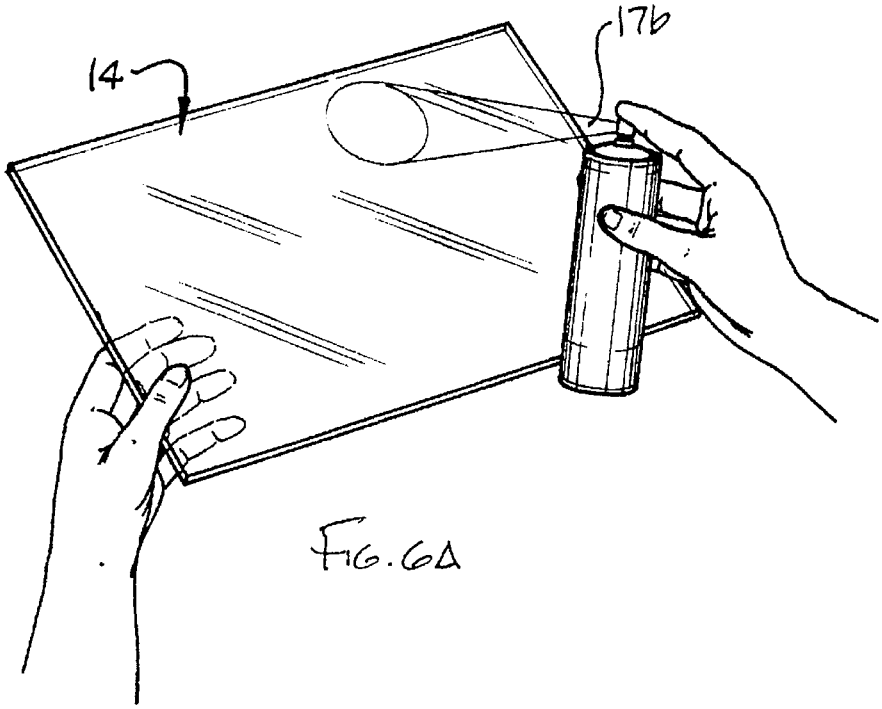
FIGS. 6A and 6B illustrate the artisan disposing an adhesive on the surfaces of the substrate.
Figure 6B:
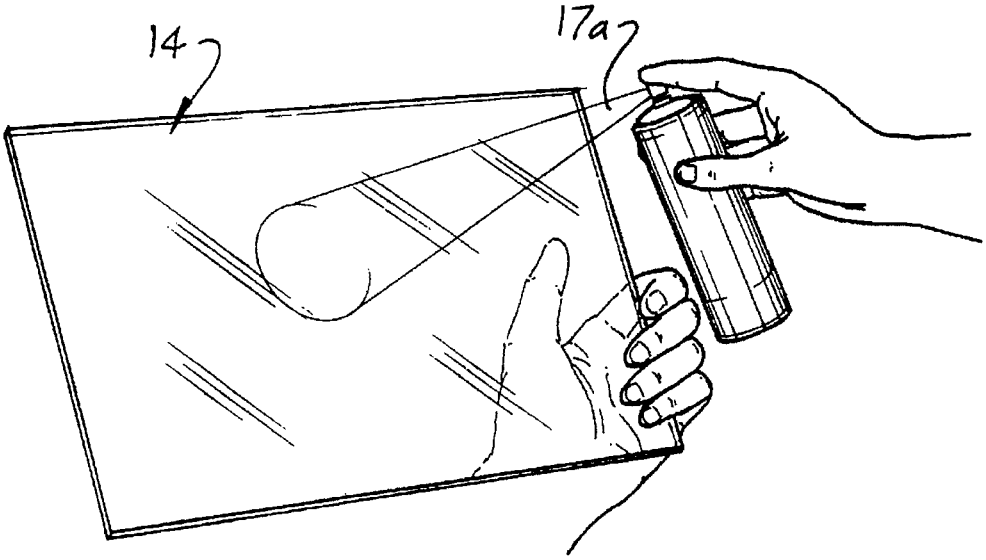

Once obtained, the artisan then disposes adhesive 17 on the upper side 16 of the substrate 14 (FIG. 6A) and on the lower side 15 of the substrate 15 (FIG. 6B). In doing so, any suitable means, such as a brush or spray, may be utilized.

Referring now to FIG. 7, once the adhesive has been applied, as noted above relative to FIG. 6B, the lower side 15 of the substrate 14 is disposed on the pattern 11. In this fashion, the adhesive 17*a* on the lower side 15 of the substrate 14 adheres the substrate 14 to the pattern 11.

With the substrate 14 secured to the pattern 11, as described above, the artisan then provides a plurality of colored beads 18, having the desired colors. These colored beads 18 are then chosen. (FIG. 8).

Figure 9:
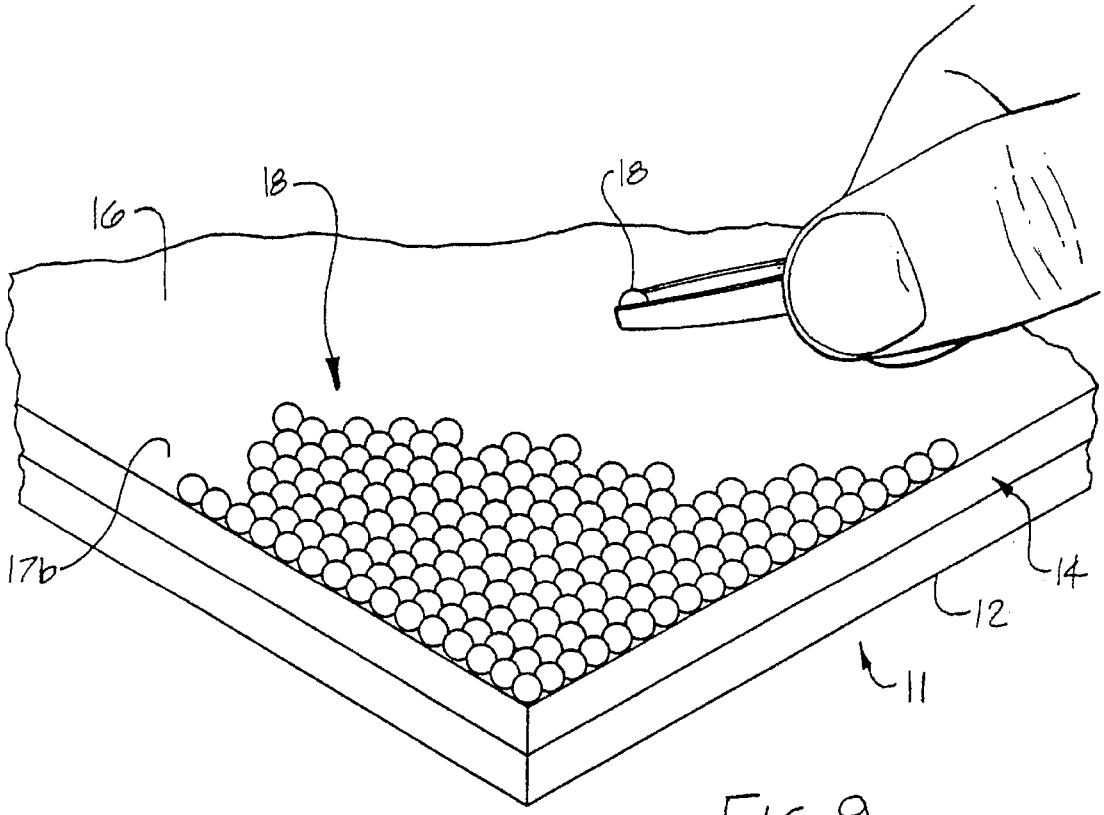

With reference now to FIG. 9, the provided and chosen beads 18 are then disposed on the upper side 16 of the transparent substrate 14. It is noted herein that beads 18 having the same color are disposed over those portions of the pattern 11 having the color to which the particular colored beads 18 correspond. In this manner, the adhesive 17*b* on the upper side 16 of the substrate 14 adheres the colored beads 18 to the upper side 16 of the substrate 14 over the selected pattern 11 including the colors thereof, such that the colored beads 18 reproduce the color pattern of the selected pattern 11.

Figure 10:
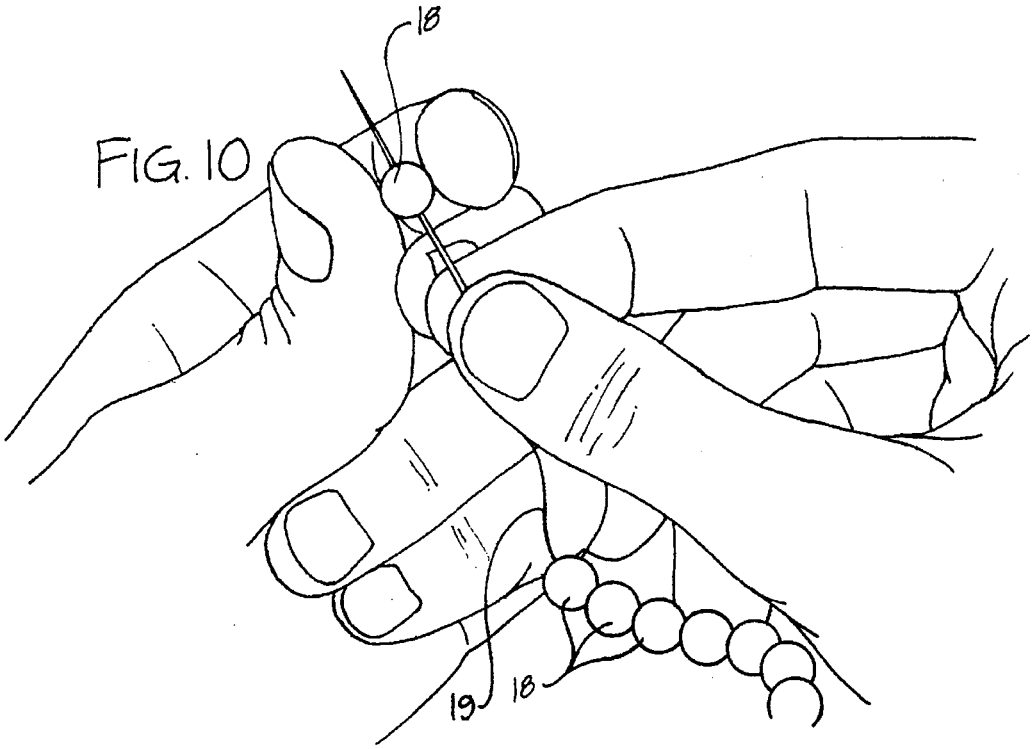
Figure 11:
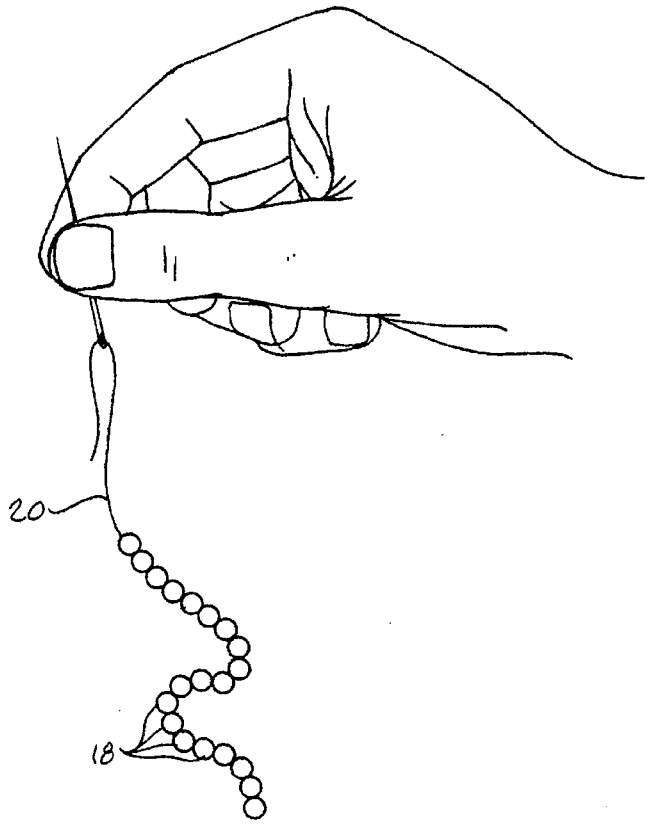
Figure 12:
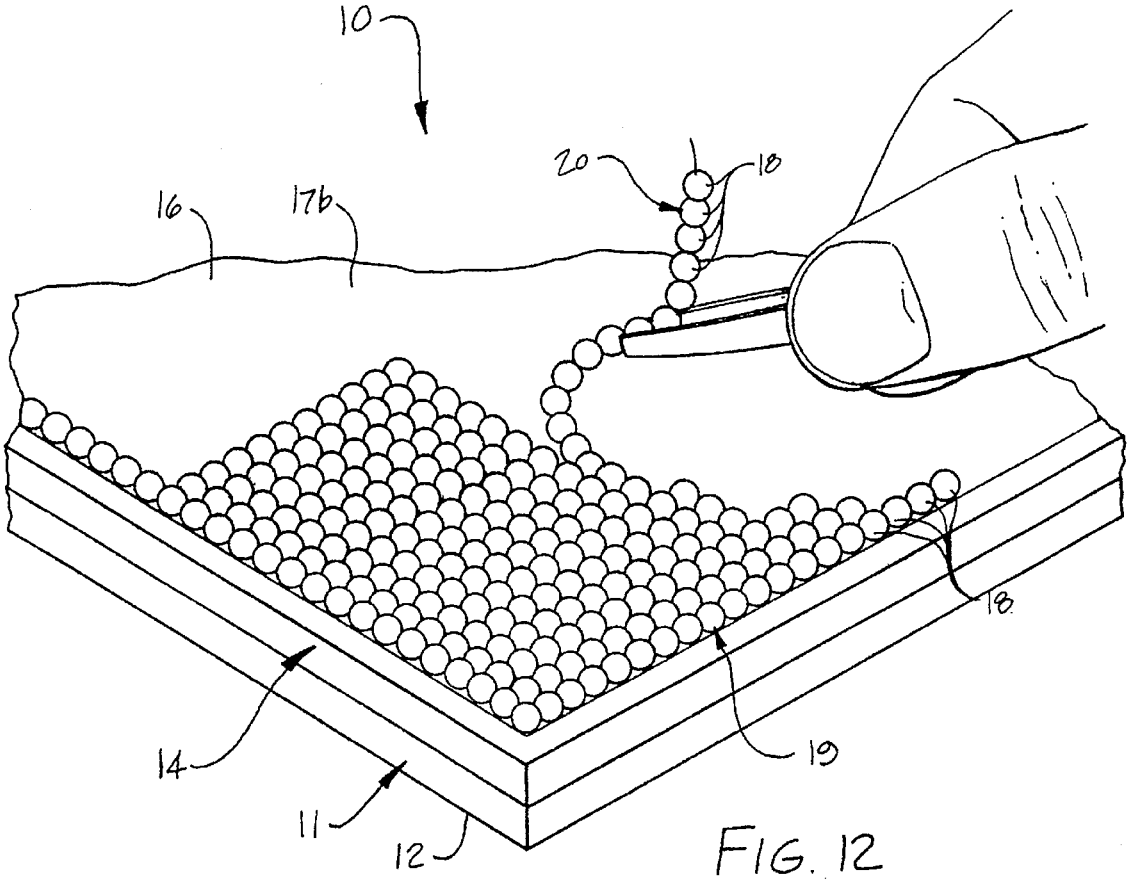

Referring now to FIGS. 10–12, an alternative manner of disposing the beads 18 on the upper side 16 of the substrate 14 is now discussed.

In this alternative manner, at least a first portion of beads 18 of a desired color are strung by the artisan on a first thread or string 19 having a first desired length. In this manner, a first string 19 of beads having a first desired length is provided. (FIG. 10). Similarly, a second portion of beads 18 of a desired color are strung by an artisan on a second thread or string 20 having a second desired length. In this manner, a second string 20 of beads having a second desired length is provided. (FIG. 11). The first and second strings 19 and 20, respectively, are then disposed on respective selected portions of the upper side 16 of the transparent substrate 14 to complete the pattern. (See FIG. 12).

It is to be understood herein, that while the method of the present invention has been described with two strings, it is to be expressly understood herein that any desired number of strings may be provided and/or utilized.

Figure 13:
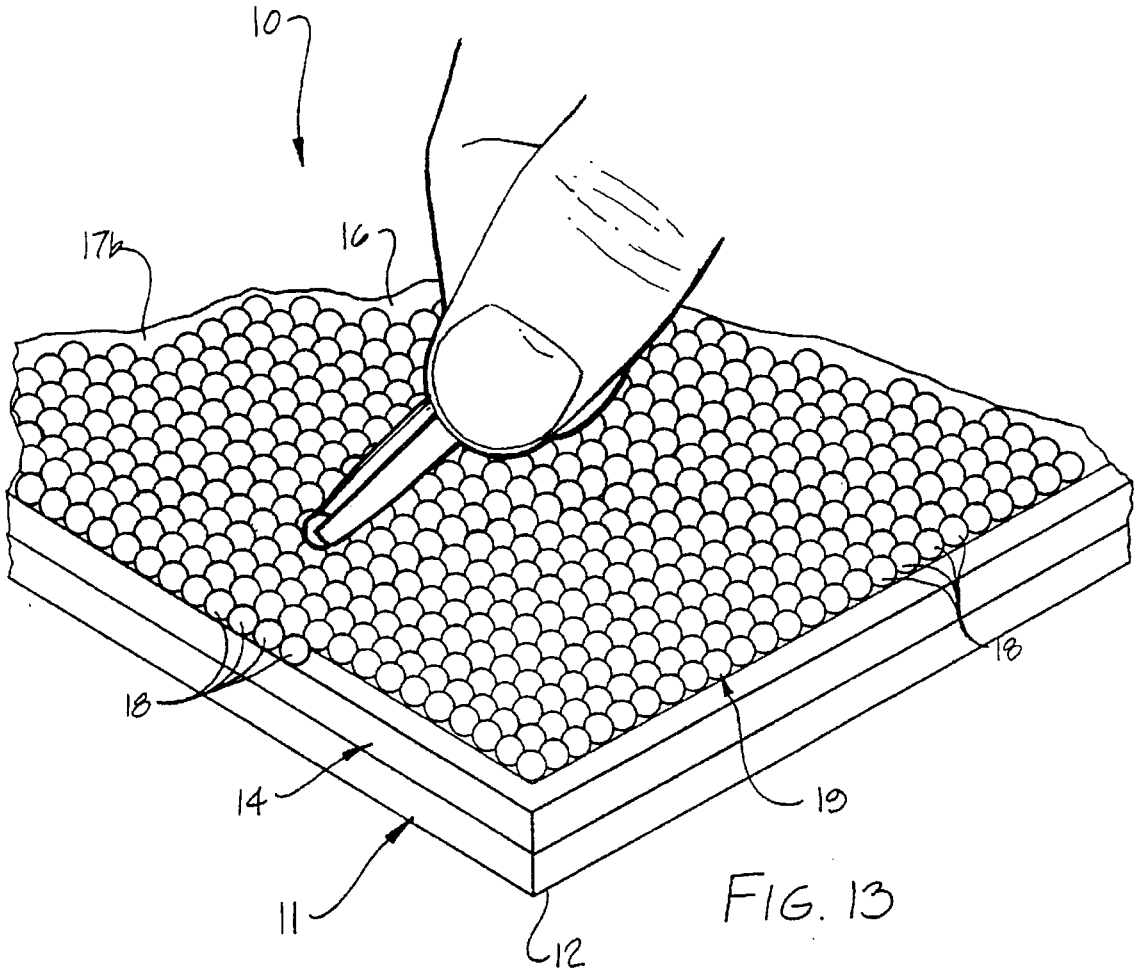

Referring now to FIG. 13, the artisan may place beads 18 around the outer edge of the upper side 16 of the substrate 14 of the display 10. In this fashion, a frame is formed thereon.

Finally, once the beads 18 have been placed on the substrate 14, so as to be adhered thereto, the display may be sealed in a transparent medium. In this manner, the beads 18 would be covered and the display sealed, so that the beads 18 could not be accidentally removed or dislodged therefrom. In this respect, such sealing forms a permanent display.

Figure 14:
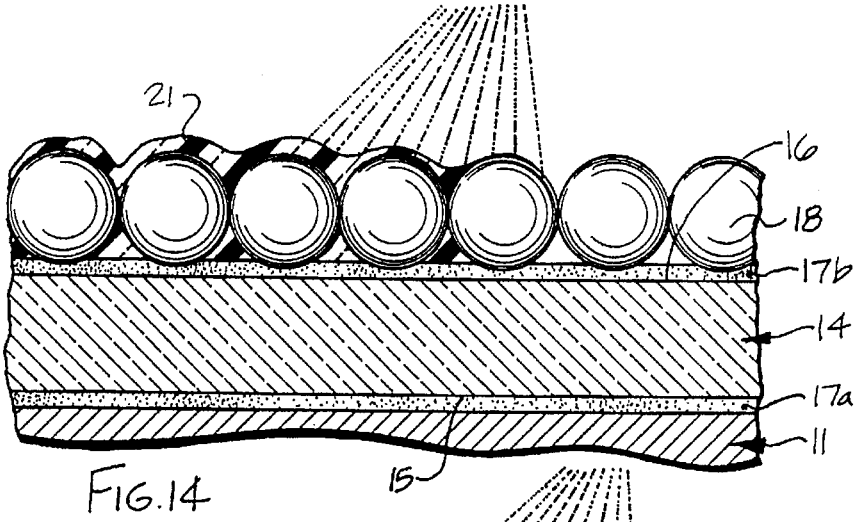
Figure 15:
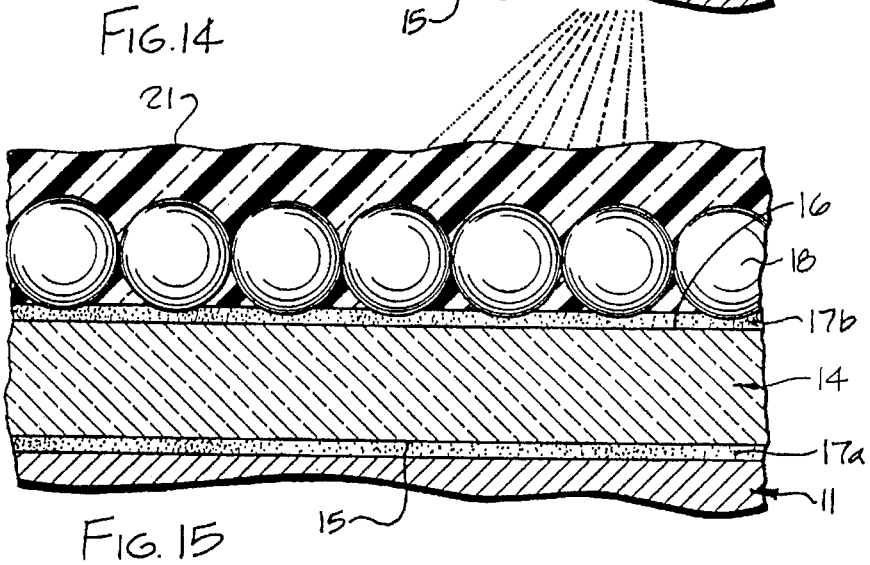
Figure 16:
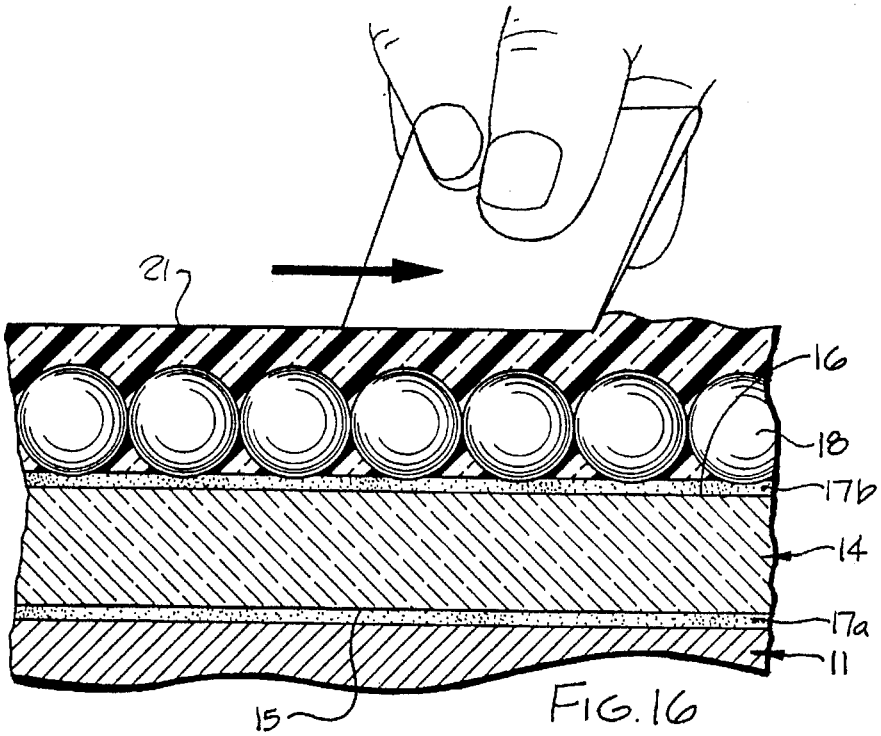

Referring now to FIGS. 14–16, a first embodiment of the step of sealing the display 10 is illustrated. In this embodiment, the sealant 21, which is preferably a transparent epoxy plastic, is poured over the beads 18 and the portion of the substrate 14 (the upper side 16) on which the beads 18 are disposed. (FIG. 14). The artisan continues to pour the sealant 21 over the beads 18 and the upper side 16 until the sealant 21 reaches a level, wherein the sealant 21 completely covers all of the beads 18, whereby the beads 18 are completely embedded in the sealant 21. (FIG. 15). When this is complete, the artisan may then smooth the top of the layer of sealant 21, so as to provide a smooth finish (FIG. 16).

Figure 17:
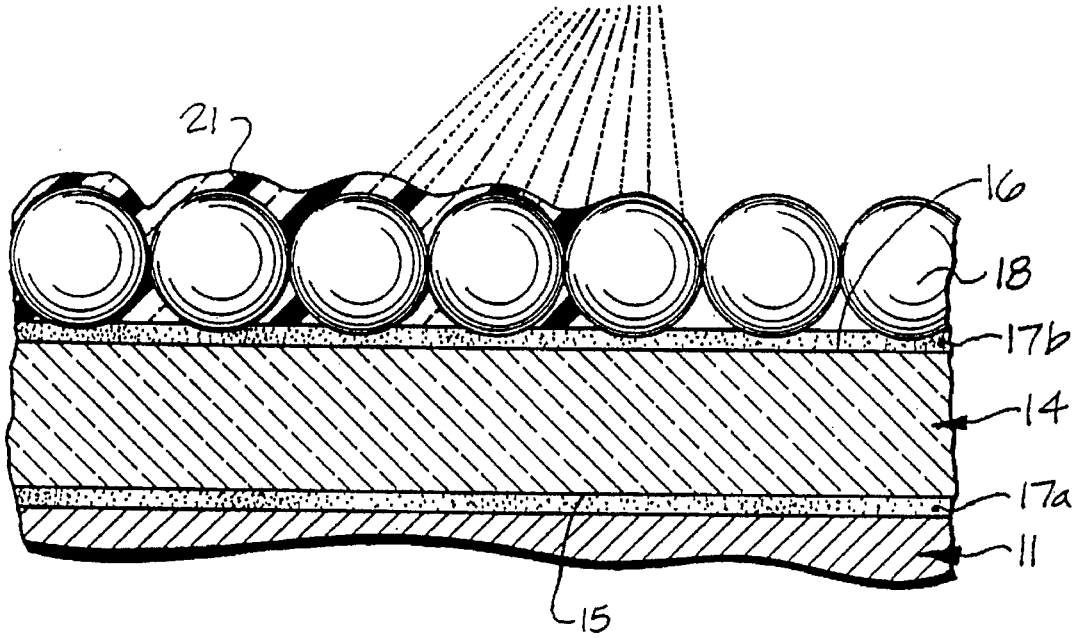
Figure 18:
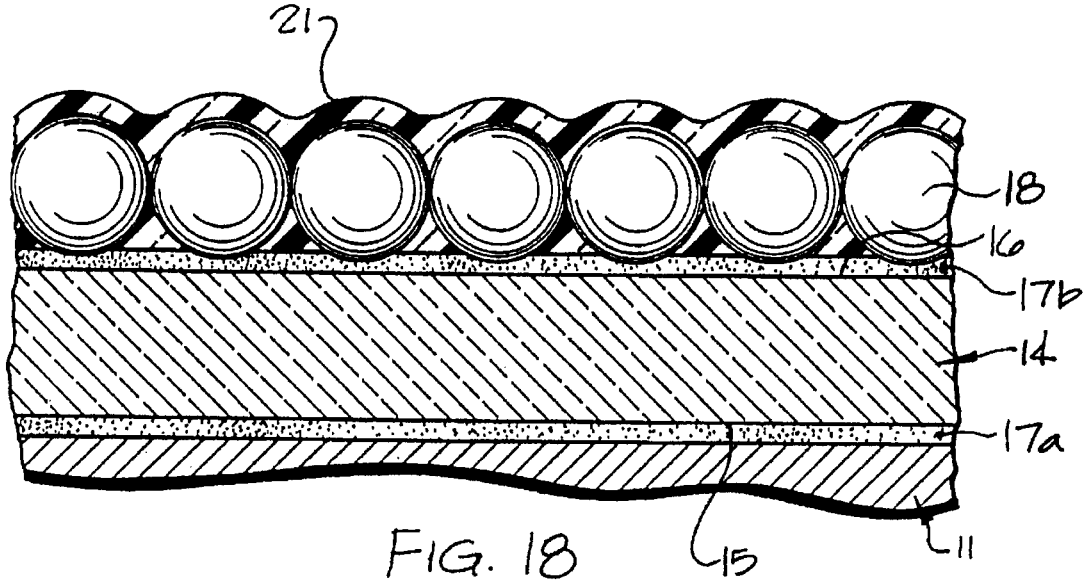

Referring now to FIGS. 17 and 18, a second embodiment of the step of sealing the display 10 is illustrated. In this embodiment, the sealant 21, which is preferably a transparent acrylic or epoxy plastic, is sprayed over the entire upper side 16 of the substrate 14 and the beads 18 disposed and adhered thereto. In this fashion, the display 10 is sealed in the sealant 21 with the irregular surface of the coated beads exposed to touch and sight.

The present invention may be used on any type of prepared surface and the display may be applied to a wide variety of items. The display may be on furniture, ceramics such as vases, purses, wall hangings, fabrics including clothing, and to virtually any item on which a display is desired.

Obviously, many modifications may be made to the display and the method of the present invention without departing from the basic spirit of the present invention. Accordingly, it will be appreciated by those skilled in the art that within the scope of the appended claims, the invention may be practiced other than has been specifically described herein.

What is claimed is:

1. A display made of beads sealed in a transparent sealant, comprised of:

a selected pattern depicting the display and including the desired colors thereof;

a transparent substrate having an upper side and a lower side;

an adhesive disposed on the upper side and the lower side of the transparent substrate;

the transparent substrate being disposed on the selected pattern, so that the adhesive on the lower side of the substrate adheres the transparent substrate to the pattern;

a plurality of beads of desired colors disposed on the upper side of the substrate over the selected pattern including the colors thereof, so that the adhesive on the upper side of the substrate adheres the beads to the transparent substrate over the corresponding colors of the pattern, whereby the colored beads reproduce the color pattern of the selected pattern; and sealant disposed on the upper side of the substrate and the beads adhered thereon, so that the display is sealed and a permanent display is obtained.

2. The display of claim 1, wherein the beads of a desired color are individual seed beads which are disposed on the upper side of the transparent substrate.

3. The display of claim 1, further comprised of:

a first thread having a first desired length, the first thread having at least a first portion of the beads of a desired color disposed thereon, whereby a first string of beads having a first desired length is defined;

the first string of beads being disposed on a selected portion of the upper side of the substrate;

a second thread having a second desired length, the second thread having at least a second portion of the beads of a desired color disposed thereon, whereby a second string of beads having a second desired length is defined; and the second string of beads being disposed on a selected portion of the upper side of the substrate.

4. The display of claim 1, wherein the sealant is a transparent epoxy plastic, whereby the display is sealed in the transparent epoxy plastic.

5. The display of claim 4, wherein the transparent epoxy plastic substantially covers all of the beads, such that the beads are completely embedded in the epoxy plastic and a smooth finish is formed.

6. The display of claim 4, wherein the transparent epoxy plastic covers the beads, such that the beads are sealed therein with the texture of the beads exposed to touch and sight.

7. The display of claim 1, further comprised of:

a plurality of beads being disposed around the outer edge of the display, such that a frame is formed thereon.

8. A display made of beads sealed in a transparent sealant, comprised of:

a selected pattern depicting the display and including the desired colors thereof;

a transparent substrate having an upper side and a lower side;

an adhesive disposed on the upper side and the lower side of the transparent substrate;

the transparent substrate being disposed on the selected pattern, so that the adhesive on the lower side of the substrate adheres the transparent substrate to the pattern;

a plurality of beads of desired colors disposed on the upper side of the substrate over the selected pattern including the colors thereof, so that the adhesive on the upper side of the substrate adheres the beads to the transparent substrate over the corresponding colors of the pattern, whereby the colored beads reproduce the color pattern of the selected pattern;

a plurality of beads being disposed around the outer edge of the display, such that a frame is formed thereon; and a transparent sealant disposed on the upper side of the substrate and the beads adhered thereon, wherein the transparent sealant substantially covers all of the beads, such that the display is sealed in the transparent sealant, and a permanent display is obtained, and further such that the beads are completely embedded in the sealant and a smooth finish is formed.

9. A display made of beads sealed in a transparent sealant, comprised of:

a selected pattern depicting the display and including the desired colors thereof;

a transparent substrate having an upper side and a lower side;

an adhesive disposed on the upper side and the lower side of the transparent substrate;

the transparent substrate being disposed on the selected pattern, so that the adhesive on the lower side of the substrate adheres the transparent substrate to the pattern;

a plurality of beads of desired colors disposed on the upper side of the substrate over the selected pattern including the colors thereof, so that the adhesive on the upper side of the substrate adheres the beads to the transparent substrate over the corresponding colors of the pattern, whereby the colored beads reproduce the color pattern of the selected pattern;

a plurality of beads being disposed around the outer edge of the display, such that a frame is formed thereon; and a transparent sealant disposed on the upper side of the substrate and the beads adhered thereon, wherein the transparent sealant covers the beads, such that the display is sealed in the transparent sealant, and further such that the beads are sealed therein with the irregular surface of the coated beads exposed to touch and sight.

* * * * *